United States Patent [19]

Harper

[11] Patent Number: 4,707,674

[45] Date of Patent: Nov. 17, 1987

[54] AUXILIARY SWITCH ACTUATOR MECHANISM

[75] Inventor: George S. Harper, Cambridge, Md.

[73] Assignee: Airpax Corporation, Cambridge, Md.

[21] Appl. No.: 852,147

[22] Filed: Apr. 15, 1986

Related U.S. Application Data

[63] Continuation-in-part of Ser. No. 815,310, Jan. 2, 1986, which is a continuation of Ser. No. 725,486, Apr. 22, 1985, abandoned.

[51] Int. Cl.[4] ..... H01H 75/00; H01H 77/00; H01H 83/00

[52] U.S. Cl. ..... 335/13; 335/160; 335/197

[58] Field of Search ..... 335/13, 17, 159, 160, 335/161, 197, 198

[56] References Cited

U.S. PATENT DOCUMENTS 3,593,232 7/1971 Shibuya ..... 335/160
3,742,402 6/1973 Nicol ..... 335/13

*Primary Examiner*—E. A. Goldberg
*Assistant Examiner*—Lincoln Donovan
*Attorney, Agent, or Firm*—Saidman, Sterne Kessler & Goldstein

[57] ABSTRACT

A circuit breaker with an auxiliary switch actuator mechanism is disclosed. The actuator mechanism includes an actuator member and a locking member. Upon resetting of the breaker, the actuator member is moved by the arm carrying the movable contact of the main breaker mechanism to a position where it is locked by the locking member. Tripping the breaker causes the locking member to unlatch and release the actuator member to switch the auxiliary switch contact to allow indication of the tripped state, while manual operation of the breaker does not alter the condition of the auxiliary switch.

35 Claims, 12 Drawing Figures

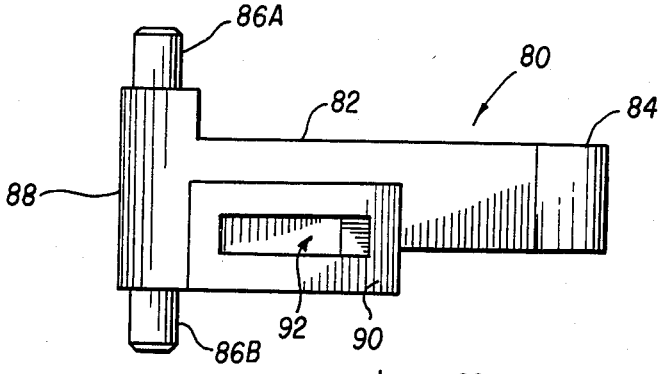
FIG. 7A
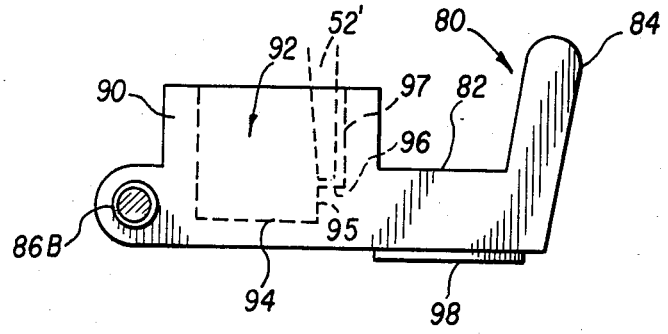
FIG. 7B
FIG. 6A
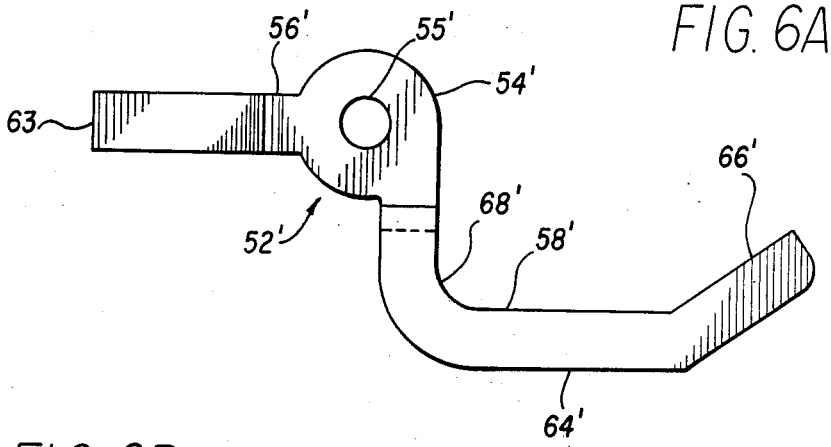
FIG. 6B
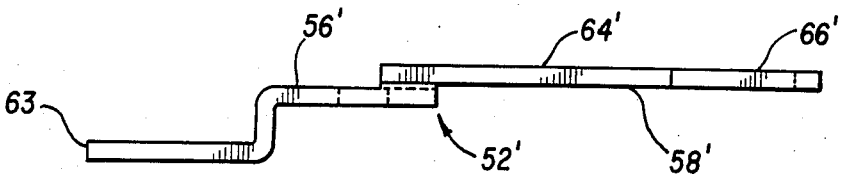

AUXILIARY SWITCH ACTUATOR MECHANISM

Cross-Reference to Related Application

This application is a continuation-in-part of U.S. patent application Ser. No. 815,310, filed Jan. 2, 1986, which in turn is a continuation, filed under 37 CFR 1.62, of Ser. No. 725,486, filed Apr. 22, 1985, abandoned.

BACKGROUND OF THE INVENTION

1. Field of the Invention

The present invention relates to circuit breakers with auxiliary switch mechanisms. More particularly, the invention relates to auxiliary switch mechanisms which indicate the status of the breaker. Still more particularly, the invention relates to auxiliary switch actuator mechanisms which, once set, operate only during an overcurrent condition to indicate an electrically tripped condition of the breaker, and which remain in their set state during normal manual operation of the circuit breaker.

2. Description of the Related Art

Circuit breakers having auxiliary switch mechanisms are known. The auxiliary switch is usually connected in an alarm circuit with an indicating device (e.g., a light, bell, etc.) to provide a remote indication of the condition of the breaker. Some of the more complex auxiliary circuits provide differing outputs responsive to the three basic breaker conditions: manually OFF, manually ON, and electrically tripped. Other common mechanisms provide an indication only when the breaker has been electrically tripped.

More particularly, in some known breakers, the auxiliary switch indicates whether the breaker is on or off, the latter state being indicated whether the breaker has been manually turned off or electrically tripped. Breakers of this type thus do not discriminate between manual operation and overcurrent conditions, and cannot be used effectively in applications which require an alarm signal to be generated when the breaker is tripped by an overcurrent condition occuring in the circuit.

Other known breakers overcome this problem by providing an auxiliary switch actuator mechanism which discriminates between on, manual off, and overcurrent tripped conditions. However, breakers of this type, one example of which is shown in U.S. Pat. No. 3,742,402, issued June 26, 1973 to Nicol, require a complicated mechanical operating mechanism having a multitude of parts which must be closely fitted into a small space.

These known breakers had the problem that in order to provide a remote indication which distinguished between normal breaker on and off conditions and the electrically tripped condition and provide signals responsive to each, a complicated mechanism was required. The less complicated mechanisms were capable of distinguishing only between on and off positions of the breaker, whether the off position was attributable to manual operation or an overcurrent condition. These problems were partially overcome by the development of a simpler auxiliary switch actuator mechanism that was capable of distinguishing between manual on/off operation and the overcurrent tripped condition of the breaker. An example of such a mechanism is shown in U.S. Pat. No. 3,593,232, issued July 13, 1971, to Shibuya et al. However, these predecessor actuator mechanisms also have certain disadvantages. Their designs present manufacturing difficulties, particularly in trying to ensure reliability of operation. These mechanisms do not operate reliably leading to increased manufacturing costs and in some cases to excessive numbers of returns. Furthermore, the commercial embodiment of the Shibuya device is unduly complex and would desirably be made using fewer parts.

The present invention is directed to providing a circuit breaker auxiliary switch actuator mechanism which utilizes a simpler, more positive, and less critically dimensioned mechanism than known devices, which provides a signal which indicates whether the breaker is in normal operation (whether the breaker contacts are open or closed) or has tripped.

SUMMARY OF THE INVENTION

The invention comprises an auxiliary switch actuator mechanism for a circuit breaker. The breaker has a frame, and a breaker mechanism mounted to the frame. The breaker mechanism includes a manually operable handle, a breaker contact pivotably mounted to the frame and movable between open and closed positions, a collapsible linkage coupling the handle and movable contact, and a sear pin cooperating with the collapsible linkage to collapse the linkage upon detection of an overcurrent through the breaker. The actuator mechanism includes an auxiliary switch having a movable contact and an actuator member coupled to the auxiliary switch movable between first and second positions for moving the auxiliary switch contact between normally-open and normally-closed positions, respectively.

In one embodiment, the actuator member has a base plate including a bifurcated portion at one end extending outwardly in the longitudinal direction of the base plate and defining an open ended channel. Alternatively, the actuator member has a base member including a locking arm receiving recess. The recess has a stepped bottom surface, including a lower bottom portion and an upper raised portion, having a definite edge. In either case, an arm portion extends upwardly from the base member to abuttingly engage the movable breaker contact when the movable breaker contact is moved to its closed position. In this way, closing of the movable breaker contact also closes the auxiliary switch.

The actuator mechanism also includes a locking member having a central portion pivotably mounted directly to the frame, preferably coaxially with the movable breaker contact. This locking member comprises first and second arms extending outwardly from the central portion. The first arm has its distal end portion disposed in the open ended channel or in the recess in the locking arm housing of the actuator member, and is biased thereagainst. In either case, the distal end of the first arm locks the actuator member when the actuator member is disposed in the closed position, locking the auxiliary switch. The second arm extends into the path of movement of the sear pin when the sear pin is tripped. When tripped, the second arm is pivoted by the sear pin to pivot the first arm out of locking engagement with the actuator member, thus releasing the auxiliary switch upon detection of an overcurrent condition. The sear pin does not contact the second arm when the breaker is manually opened, such that the auxiliary switch is not thereby affected.

The above-described features and advantages are best understood in view of the subsequent description of the preferred embodiments of the present invention, and in view of the accompanying drawings.

BRIEF DESCRIPTION OF THE DRAWINGS

FIG. 6A is a front elevational view of a second embodiment of the locking arm;

FIG. 6B is a side elevational view of a second embodiment of the locking arm;

FIG. 7A is a top plan view of a second embodiment of the actuator member;

FIG. 7B is a side elevational view of a second embodiment of the actuator member.

DESCRIPTION OF THE PREFERRED EMBODIMENTS

Figure 1:
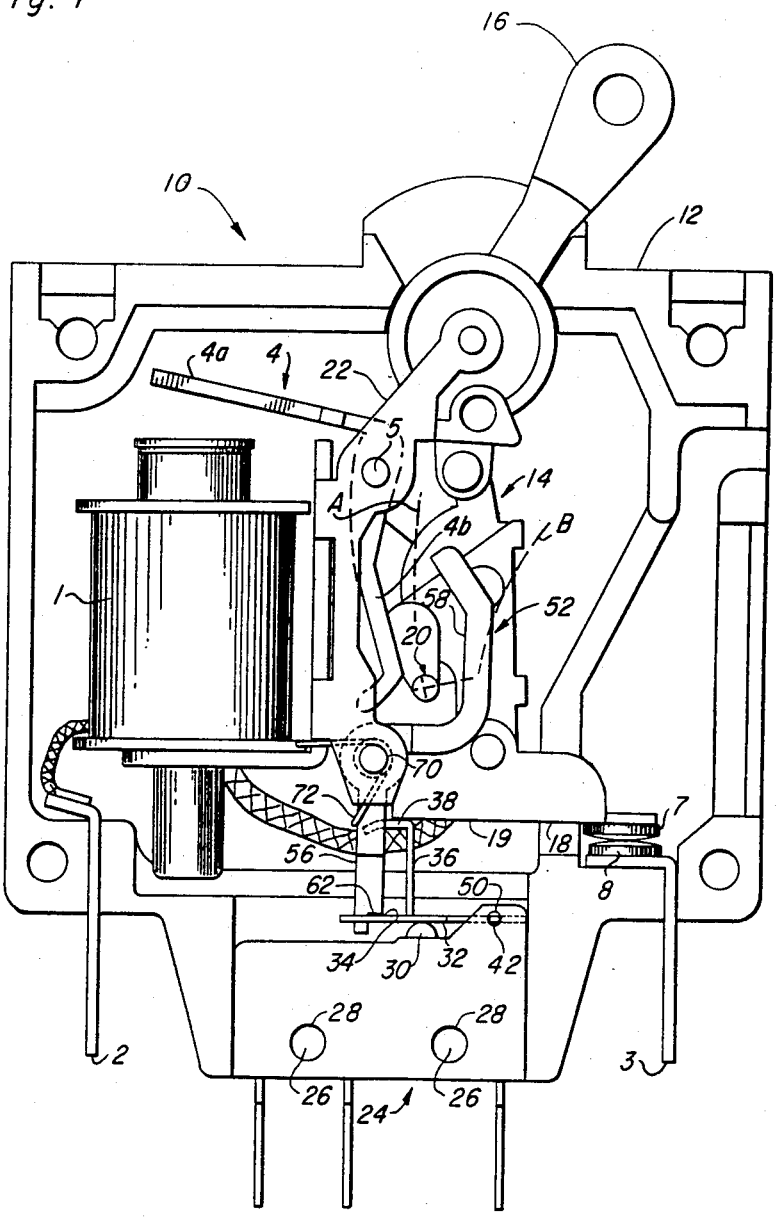
FIG. 1 is a side view of the circuit breaker mechanism in accordance with a first embodiment of the present invention with the circuit breaker in the ON position.

As mentioned, Shibuya et al U.S. Pat. No. 3,593,232 shows a circuit breaker including an auxiliary switch which provides an unambiguous indication of tripping due to overcurrent. The device shown therein (and the commercial embodiment thereof) is unduly complex, has a large number of parts, and is difficult to manufacture.

In particular, the Shibuya device includes a first frame, not shown in the Shibuya patent, on which are mounted the coil 3 and the armature 31. The pivot axis of the moving contact arm 5 is defined by a pin 30 carried in recesses in the two halves of the breaker housing. (This design is the source of some of the assembly difficulties mentioned above). The collapsible linkage and sear pin triggering assembly 21, 24, 25 and 23 is carried between pin 30 and a second pin 20, which in turn is retained by a boss on the handle 18. In the Shibuya patent, handle 18 includes two pins 19 which fit into recesses in the casing halves. In the commercial device, these were molded integrally with the handle. Finally, the locking lever for the auxiliary switch is carried by a second frame 29. In the U.S. Pat. No. 3,593,232 second frame 29 is located by pin 19.

The second frame in the commercial embodiment of the Shibuya device is located by pin 30 and by yet another pin fitting into recesses in the case halves, which is not shown in the patent.

FIG. 1 shows a preferred embodiment of the auxiliary contact switch mechanism of the present invention as incorporated into a circuit breaker. The circuit breaker 10 comprises a case 12 formed of an electrically insulating material, such as plastic. The case contains a breaker mechanism, generally designated 14, which includes a collapsible linkage mechanism operatively connecting a handle 16 and a movable contact arm 18. A trigger mechanism which includes a sear pin 20, comprises a portion of the breaker mechanism which controls the collapsible linkage. The breaker mechanism 14, handle 16, and contact arm 18 are all mounted to a frame 22. Upon passage of an overcurrent through coil 1, connected in circuit between terminals 2 and 3, an end **4*a* of armature 4 pivoted about a pin 5 carried by frame 22 is attracted to the coil. Thereupon a second end 4b of the armature is pivoted to strike sear pin 20 of the trigger mechanism, causing the collapsible linkage to collapse, tripping the breaker, and separating contacts 7 and 8** from one another. Representative breaker mechanisms with which the present invention may be used are dislcosed in detail in commonly assigned U.S. Pat. No. 4,117,285 issued Sept. 26, 1978 to Harper and U.S. patent application Ser. No. 486,716, filed Apr. 20, 1983, by Harper; the disclosures of the U.S. Pat. No. 4117,285 and Ser. No. 486,716 application are incorporated herein in their entirety by reference as though set forth in full. Where not discussed herein, other elements of the breaker of the invention are as shown in these additional disclosures.

An auxiliary switch 24 is mount in the lower portion of casing 12. Typically, cang 12 is composed of two halves, each of which contains pin members 26 which mate with holes 28 is the auxiliary switch 24 for mounting the auxiliary switch 24 in the proper position in the breaker 10. Typically, the switch 24 comprises a microswitch assembly having a set of auxiliary contacts which are operated by an internal contact (not shown). A movable pin 30 is spring biased to extend upwardly through the plastic housing of switch 24. Pin 30 engages the internal contact to control its on-off operation. Such switches are known in the art and are exemplified by the switch shown in the Shibuya et al. U.S. Pat. No. 3,593,232, discussed above. The disclosure of the U.S. Pat. No. 3,593,232 Shibuya is incorporated herein in its entirety by reference as though set forth in full.

Figure 3A:
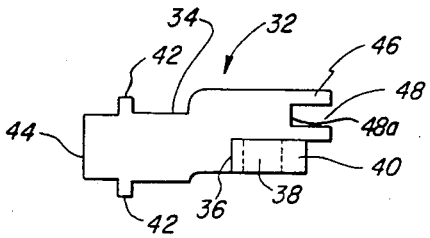
FIG. 3A is a top plan view of a first embodiment of the actuator member.
Figure 3B:
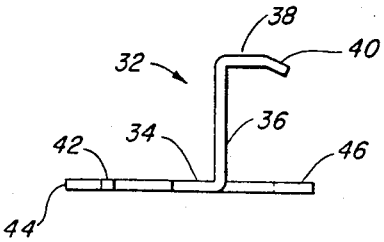
FIG. 3B is a side elevational view of a first embodiment of the actuator member.

In a first embodiment of the present invention, the movable pin 30 and hence the switch 24 are under the immediate control of an actuator member 32. Referring to FIGS. 3A and 3B, actuator member 32 comprises a base plate 34 and an arm 36 extending upwardly from the base plate 34. The distal end of the arm 36 terminates in a flange 38 having a downwardly bent lip 40 at its end.

A pair of pivot pins 42 extend laterally outwardly from the plate 34 near an end 44 thereof. The longitudinally opposite end 46 of plate 34 has a channel 48 formed therein to thereby define a bifurcated or fork-shaped end portion, whose purpose will be described in more detail below. Pivot pins 42 seat in corresponding pivot mount openings 50 in the casing of switch 24. Base plate 34 rests on movable pin 30. An end portion 44 cooperates with the switch casing to act as a stop to limit the pivotal motion of actuator 32 in the direction away from pin 30.

Figure 2A:
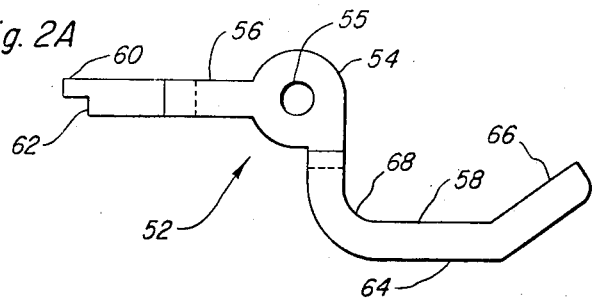
FIG. 2A is a front elevational view of a first embodiment of the locking arm.
Figure 2B:
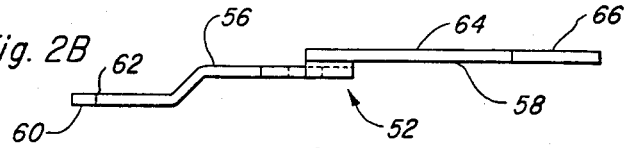
FIG. 2B is a side elevational view of the first embodiment of the locking arm.

The auxiliary switch actuating mechanism of the first embodiment of this invention also includes a locking member of arm, generally designated 52. Referring to FIGS. 2A and 2B, the locking member 52 has a central portion 54 which defines a central opening 55 therein. A first arm 56 extends radially from central portion 54 in a first direction. A finger 60 and a shoulder 62 are formed at the distal end of first arm 56. Arm 56 of locking member 52 rides in channel 48 of actuator member 32. A second arm 58 extends from central opening 54 at an angle to arm 56. Second arm 58 has a generally J-shaped configuration. Arm 58 has an intermediate body portion 64 and a hooked end portion 66, extending from the distal end of intermediate body portion 64. A connecting leg portion 68 extends from the proximal end of the intermediate body portion 64 substantially at right angles thereto and connects it to the central portion 54' substantially at right angles to the first arm 56. Intermediate portion 64 therefore extends substantially parallel to the first arm 56.

The locking member 52 is mounted on frame 22 by means of a pivot pin 70 which passes through opening 55 and corresponding mounting holes in the frame 22. Pin 70 also mounts contact arm 18 to the frame 22. Pin 70 thus defines an axis about which both contact arm 18 and locking arm 52 pivot. (Mounting pin 70 corresponds to the mounting pin 83 shown in FIGS. 1 and 2 of the aforementioned Ser. No. 486,716 application.) A bias spring 72 also mounts on pin 70 over a spring bushing (not shown) and engages arm 56 to bias the locking member 52 toward a normally locked position. That is, spring 72 urges member 52 to rotate counterclockwise in FIG. 1. A second spring (not shown) is coaxial with spring 72, and acts similarly to bias contact arm 18 in the counterclockwise direction, to ensure that the contacts 7 and 8 are separated when the breaker is tripped.

FIG. 1 shows a side view of the auxiliary switch and switch actuator and breaker mechanism of this embodiment of the invention with the breaker in the ON position, i.e. the main contacts 7 and 8 are abutting.

Figure 4:
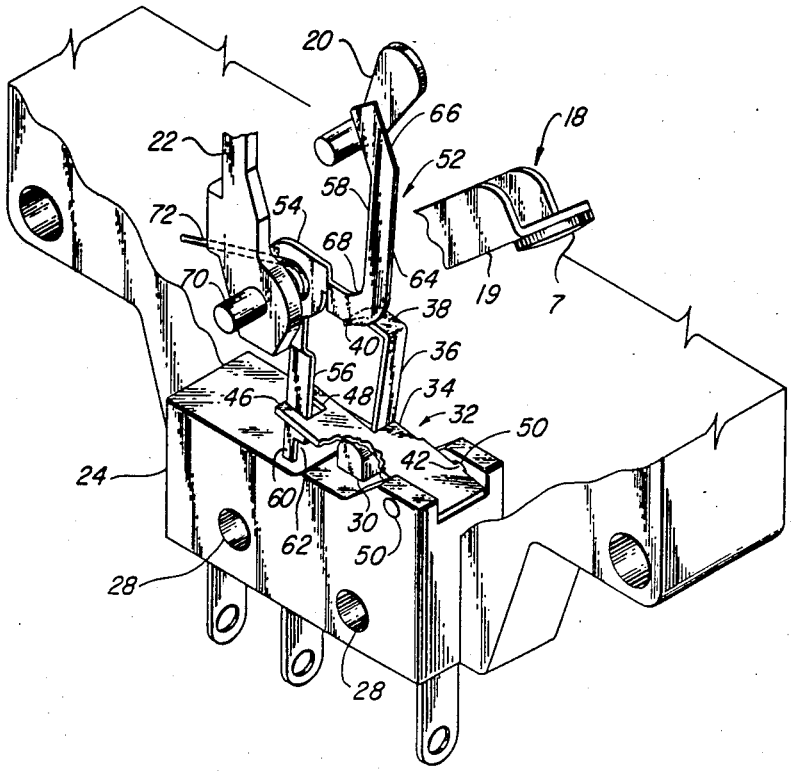
FIG. 4 is a side perspective view of the locking arm, the actuator member, and the auxiliary contact switch in accordance with the first embodiment of the present invention, showing the circuit breaker in the tripped position.

FIG. 4 shows a partly cut-away perspective view of this breaker in the OFF position. Comparison of these two figures will make the operation of the breaker of the invention clear to those of skill in the art.

When the breaker handle 16 is moved from the OFF position to the ON position, that is, to the right in FIG. 1, the breaker mechanism 14 acts on movable contact arm 18, causing it to pivot about the pivot axis defined by mounting pin 70, bringing the movable contact 7 on arm 18 into engagement with the fixed breaker contact 8 as shown in FIG. 1. The electrical circuit through the breaker is then completed and current can flow through the breaker in the normal manner. As the movable contact arm 18 pivots under the action of the breaker mechanism 14, the bottom surface 19 of arm 18 engages the flange 38 of actuator arm 36. This causes actuator member 32 to pivot about the axis defined by mounting pins 42 against the spring pressure exerted by the internally sprung contact of the auxiliary switch, acting through movable pin 30. Continued movement of actuator 32 causes the inward edge **48*a* of the slot 48 formed by the bifurcated end shape of actuator member 32 to slide past shoulder 62 of locking member 52. Due to the bias of spring 72, urging member 52 to pivot counterclockwise about pin 70, shoulder 62 overrides the upper surface of base plate 34 at this point, forming a stop and preventing movement of actuator member 32 in the opposite direction, i.e. upwardly in FIG. 1. Finger 60 engages the back edge 48*a* of the slot 48, limiting the counterclockwise motion of arm 52. The auxiliary switch is then held in the actuated position until the shoulder 62 of locking arm 56 is moved out of engagement with the actuator member 32**.

Typically, auxiliary switch 24 will have three contact terminals: a common or "C" terminal (to which the spring contact is connected), a normally open or "N/O" terminal, and a normally closed or "N/C" terminal. Current flows through the auxiliary switch spring contact member between the common or "C" terminal and either the N/C or N/O terminal. When the circuit breaker is turned ON (closing the circuit through the main breaker contacts), the actuator member 32 sets the auxiliary switch 24, in the manner described above, to close a circuit between the C and N/O terminals. This is the N/O state of auxiliary switch 24. Operation of the auxiliary switch in the opposite sense, i.e. such that the C terminal is connected to the N/C terminal when the main breaker contacts abut, is, of course, also within the scope of this invention.

During normal operation of the circuit breaker, when the handle 16 is manually moved between the ON and OFF positions, shown respectively in FIGS. 1 and 4, sear pin 20 engages the link members of the breaker mechanism 14 to prevent the linkage from collapsing. When the handle 16 is manually moved from the ON to the OFF position by an operator under normal operating conditions, the link mechanism 14 remains locked by the engagement of the sear pin 20. As the handle pivots from the ON to the OFF position, sear pin 20 follows a first path of travel which keeps the sear pin 20 clear of contact with the arm 58 of locking member 52. As movable contact arm 18 pivots upwardly about pivot pin 70, moving movable contact 7 out of engagement with the fixed contact 8, and thereby opening the main circuit, the force exerted by arm 18 on pin 30 of auxiliary switch 24 through arm 36 of actuator member 32 is released. In the absence of any restraint on actuator 32, the bias on pin 30 exerted by the internal spring of switch 24 would cause the internal contact to be returned to the N/C position. This is prevented, however, by the action of the locking member 52. The shoulder 62 of arm 56 acts as a stop against base plate 34 of actuator member 32 to restrain the upward movement of actuator member 32 due to the biasing force exerted thereon by the auxiliary switch internal contact through movable pin 30. Therefore, when the breaker is manually opened, the contacts of auxiliary switch 24 remain in the N/O state.

By comparison, when the breaker is tripped by an overcurrent through the main circuit, the armature 4 strikes the sear pin 20, causing it to collapse the linkage mechanism in a known manner, and opening the main circuit. The collapsing action of the linkage mechanism causes the sear pin 20 to move in a second path of travel which brings it into contact with the second arm 58 of locking member 52. Continued movement of sear pin 20 causes locking member 52 to rotate about pivot pin 70, against the bias provided by spring 72. This, in turn, causes shoulder 62 to be disengaged from plate 34, releasing the actuator member 32. Movable pin 30 can then be moved outwardly by the internally biased spring contact, so that the auxiliary switch 24 switches from the N/O state to the N/C state. An alarm circuit connected between the C and N/C terminals of the auxiliary switch 24 thus will be closed. This can be used to provide a remote indication of the tripped breaker condition.

FIGS. 5–8 show a second embodiment of the auxiliary switch mechanism of the present invention. Elements which are identical to those of the first embodiment retain the same reference numbers. Elements which are modified forms of those shown in the first embodiment are represented by primed reference numbers, and totally new elements are shown with new reference numbers.

Figure 5:
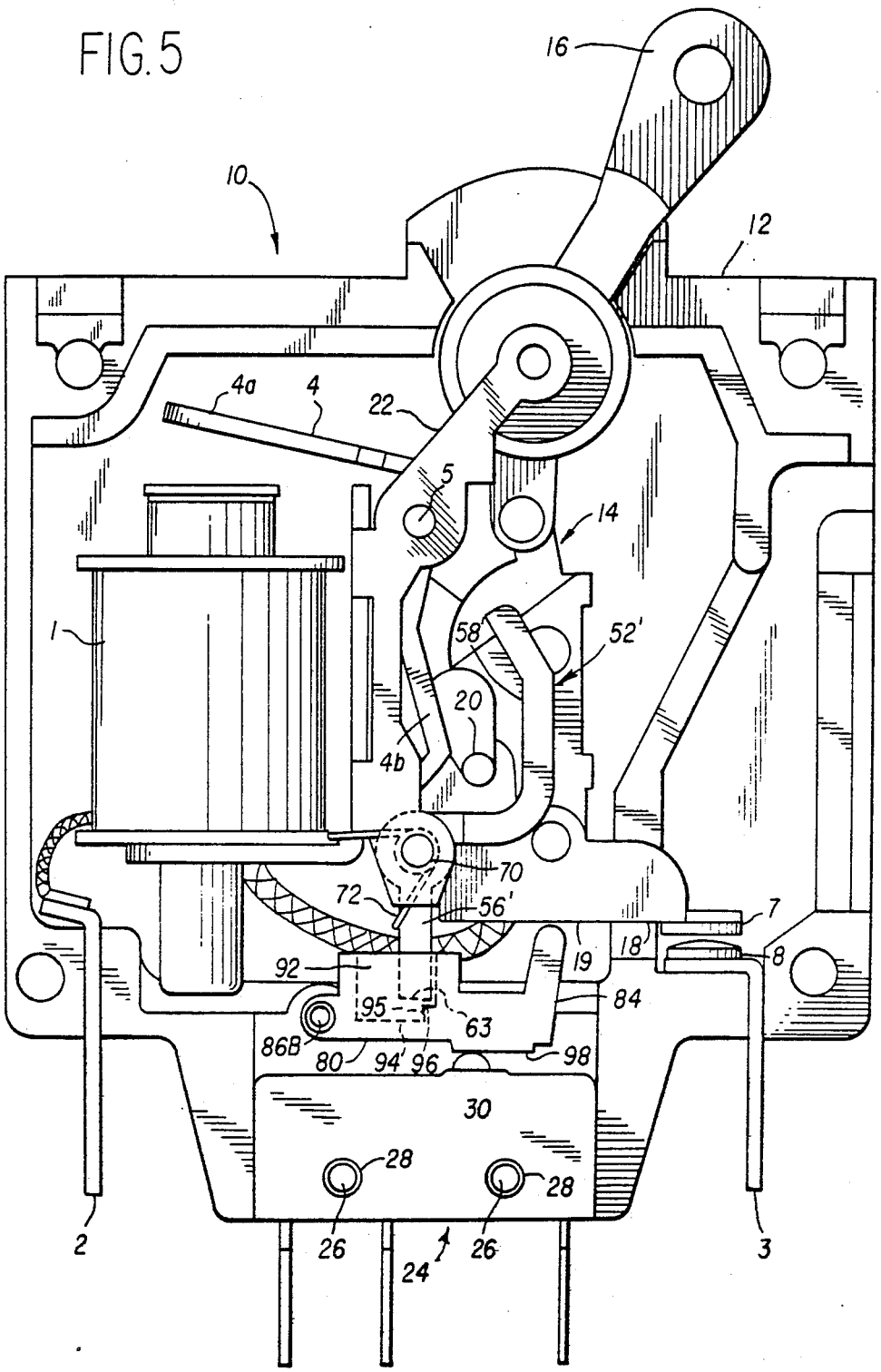
FIG. 5 is a side view of the circuit breaker mechanism in accordance with a second embodiment of the present invention with the circuit breaker in the ON position.
Figure 8:
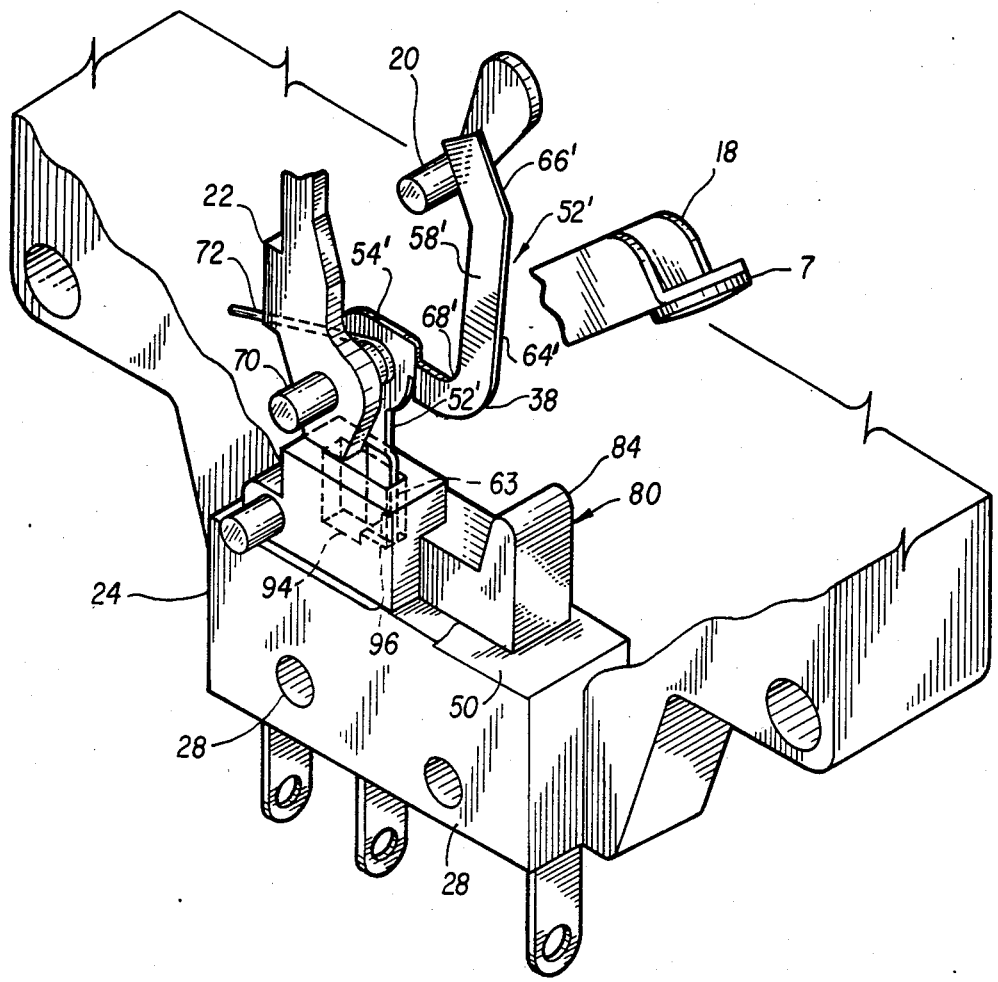
FIG. 8 is a side perspective view of the locking arm, the actuator member, and the auxiliary contact switch in accordance with the second embodiment of the present invention, showing the circuit breaker in the tripped position.

FIG. 5 shows a side view of the breaker mechanism of the second embodiment with the main contacts closed, and FIG. 8 shows a cutaway perspective view of the second embodiment with the main contacts open. FIG. 8 shows the auxiliary switch in the N/O state, that is, after a manual opening of the main contacts. Except as discussed below, the operation of the breaker in the second embodiment is the same as that in the first embodiment.

Referring to FIG. 5, the movable pin 30 is under the immediate control of an actuator member 80. As shown in FIGS. 7A and 7B, actuator member 80 comprises a base portion 82 and an arm 84. Arm 84 extends upwardly from the base portion 82. The base portion 82 further has a box-shaped housing for receiving locking member 52'. A recess 92 in housing 90 terminates in a floor portion 94 and a raised edge portion 96. A lower wall portion 95 joins floor portion 94 and raised edge portion 96, and a back wall portion 97 joins raised edge portion 96 with the periphery of recess 92. A step is thus formed at the junction of the bottom and back walls of the recess 92. A shim 98 may be attached to the outer bottom surface of the actuator member 80, where it engages the movable pin 30. The shim 98 can be used as needed to compensate for varying tolerances due to the fit of the auxiliary switch in the casing, or to increase the upward force exerted on the actuator member 80 by the spring biased movable pin 30.

A pair of pivot pins **86*a* and 86*b* extend laterally outward from the base portion 82 of the actuator member 80 near an end 88 thereof opposite the end from which the arm 84 extends. Pivot pins 86*a* and 86*b* seat in corresponding pivot mounting openings in breaker casing 12**.

FIGS. 6A and 6B show the locking member 52' of the second embodiment. Locking member 52' has an arm 56' which terminates at a square end 63; whereas locking member 52 terminates in finger 60 and shoulder 62.

The second embodiment of the invention operates generally similarly to the first, with some differences as noted below: When the movable contact arm 18 is pivoted under the action of the breaker mechanism 14 during resetting of the breaker, the bottom surface 19 of arm 18 abuttingly engages arm portion 84 of actuator member 80. This causes the actuator member 80 to pivot about the axis defined by mounting pin **86*a* and 86*b* against the spring bias acting through movable pin 30. When actuator 80 is pivoted clockwise about the axis defined by pins 86*a* and 86*b* during resetting of the breaker, the end 63 of the locking member 52' slides upwardly along wall portion 95 connecting the floor 94 of recess 92 in actuator 80 toward the raised edge portion 96. When, the end 63 reaches the level of raised edge portion 96 of locking arm housing 80, bias spring 72 urges member 52' to pivot about pin 70, so that end 63 overrides the raised edge portion 96, to abut the back wall 97 of recess 92, as shown in FIG. 5. This forms a stop against movement of actuator member 80 in the opposite direction, i.e. prevents it from pivoting upwardly if the breaker contacts are opened normally. This locking action caused by the interaction between the squared end 63 and the raised edge portion 96 corresponds to the interaction between the finger 60 and shoulder 62 of locking arm 52 and the bifurcated end portion of actuator member 32** in the first embodiment of the invention.

As in the first embodiment, when the breaker is tripped by an overcurrent through the main circuit, sear pin 20 is pivoted by arm 46 to strike arm 58' of locking member 52' and rotate member 52' clockwise about the pivot pin 70 against the action of bias spring 72. This, in turn, causes end 63 of the locking arm 52' to be disengaged from raised edge portion 96 of recess 92. This releases the actuator member 80; as the moving contact arm 18 has already moved out of engagement with arm 84, the bias on movable pin 30 urges actuator 80 upwardly. This allows switch 24 to switch from the N/O state to the N/C state.

When the breaker is manually turned off, the sear pin 20 travels in a path so that it does not strike the locking member 52'. Hence the auxiliary switch is not disturbed, and it remains it its N/O state.

The auxiliary switch actuator mechanism of this invention is composed of only three essential parts: the actuator member 32 or 80, the locking member 52 or 52', and the bias spring 72. The actuator member 32 or 80 and locking member 52 or 52' are mountable to almost any standard breaker mechanism. Since the two parts are mounted in an interlocking arrangement, there is no need to manufacture them to close tolerance. By virtue of their interlocking arrangement, they provide essentially trouble-free, reliable operation over the normal life of the breaker. Further, the locking member 52 or 52' pivots on the same frame as does the contact arm, resulting in a simplified construction over known devices.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. An auxiliary switch actuator mechanism for a circuit breaker having a breaker mechanism including a manually operable handle, breaker contact means pivotably movable between open and closed positions, collapsible linkage means coupling the handle and movable contact means, means for triggering the collapse of said linkage upon an overcurrent through said breaker, and an auxiliary switch having a contact means movable between normally-open and normally closed positions, said actuator mechanism comprising:

actuator means coupled to said auxiliary switch and movable between first and second positions controlling movement of said auxiliary switch contact means between said normally-open and normally-closed positions, respectively, said actuator means having a base plate containing an open fork portion at one end extending outwardly in the longitudinal direction of the base plate and an arm portion extending at an angle to said base plate and obuttingly engageable with said movable breaker contact means when said movable breaker contact means is moved to its closed position; and locking means having a central portion pivotably mounted coaxially with said movable breaker contact means, and first and second arm portions extending outwardly from said central portion in different directions, said first arm portion having its distal end portion disposed in said open ended channel of said actuator means and having means for engaging said actuator means when said actuator means is disposed in its second position to lock said actuator means in said second position, and said second arm portion extending into the path of movement of said triggering means when said breaker mechanism is tripped, said second arm portion being pivoted by said triggering means to thereby pivot said first arm portion out of locking engagement with said actuator means.

2. An auxiliary switch actuator mechanism according to claim 1, wherein said means for interlocking engagement includes a narrow finger portion adapted for abutting engegement with said internal edge of said actuator means and a shoulder for abutting engagement with the top surface of said actuator means when said actuator means is in said second position.

3. An auxiliary switch actuator mechanism according to claim 2 wherein said second arm portion of said actuator means is hook shaped.

4. An auxiliary switch actuator mechanism according to claim 1, wherein said actuator means further comprises means for pivotably mounting said base plate to said auxiliary switch in overlying engagement with said auxiliary switch movable contact means.

5. An auxiliary switch actuator mechanism according to claim 1, further comprising means for normally biasing said first arm portion of said locking means towards said position of locking engagement with said actuator means.

6. An auxiliary switch actuator mechanism according to claim 5, further comprising means for normally biasing said actuator means towards its first position.

7. An auxiliary switch actuator mechamism according to claim 6, further comprising means for pivotably mounting said base plate to said auxiliary switch in overlying engagement with said auxiliary switch movable contact means, and means for limiting the extent of pivotal movement of said base plate toward said actuator means first position.

8. An auxiliary switch actuator mechanism for a circuit breaker having a breaker mechanism including a manually operable handle, breaker contact means pivotably movable between open and closed positions, collapsible linkage means coupling the handle and movable breaker contact means, means for triggering the collapse of said linkage upon an overcurrent through said breaker, and an auxiliary switch having a contact means movable between normally-open and normally-closed positions, said actuator mechanism comprising:

actuator means pivotally movable between first and second positions for moving said auxiliary switch contact means between said normally-open and normally-closed positions, respectively, said actuator means comprising a base plate, a locking arm housing having a recess therein including a bottom portion and a raised edge portion, and an arm portion extending at an angle to said base plate and adapted to engage with said movable breaker contact means; and a locking member having a central portion pivotably mounted coaxially with said movable breaker contact means, and first and second arm portions extending outwardly from said central portion in different directions, said first arm portion having its distal end portion disposed in said recess and having means for engaging said raised edge portion when said actuator is disposed in its second position, to lock said actuator means in said second position, and said second arm portion extending into the path of movement of said triggering means when said breaker mechanism is tripped, said second arm portion being pivoted by said triggering means to thereby pivot said first arm portion out of locking engagement with said actuator means.

9. An auxiliary switch actuator mechanism according to claim 8, wherein said means for engaging said raised edge portion is a narrow finger portion adopted for abutting engagement with said raised edge portion of said recess.

10. An auxiliary switch actuator mechanism according to claim 9, wherein said second arm portion of said locking member is hook shaped.

11. An auxiliary switch actuator mechanism according to claim 8, wherein said actuator means further comprises means for pivotably mounting said base plate to said breaker casing in overlying engagement with said auxiliary switch contact means.

12. An auxiliary switch actuator mechanism according to claim 8, further comprising means for normally biasing said first arm portion of said locking member towards said raised edge portion of said recess.

13. An auxiliary switch actuator mechanism according to claim 13, further comprising means for normally biasing said actuator means towards the first arm portion of said locking member.

14. An auxiliary switch actuator mechanism according to claim 13, further comprising means for pivotably mounting said base plate in overlying engagement with said auxiliary switch contact means, and means for limiting the extent of pivotal movement of said base plate toward said first arm portion.

15. An auxiliary switch actuator mechanism for a circuit breaker mechanism including a manually operable handle, breaker contact means pivotally movable between open and closed positions, collapsible linkage means coupling the handle and movable contact means, means for triggering the collapse of said linkage responsive to an overcurrent through said breaker, and an auxiliary switch having a contact means movable between normally-open and normally-closed positions, said actuator mechanism comprising:

actuator means pivotally coupled to said auxiliary switch and movable between first and second positions for moving said auxiliary switch contact means between said normally-open and normally-closed positions, respectively, said actuator means comprising a base portion extending substantially perpendicular to its pivot axis;

an actuator arm portion for transferring the movement of said movable contact means to said actuator means, such that when said movable contact means is moved between its open and closed positions said arm portion causes said auxiliary switch contact means to move between said normally-open and normally-closed positions; and locking lever means having a central portion pivotally mounted coaxially with said movable breaker contact means, and first and second locking lever arms extending outwardly from said central portion in different directions, said first locking lever arm including means for locking said actuator means in said second position, and said second locking lever arm extending into the path of movement of said triggering means when said breaker mechanism is tripped, said second locking lever arm being pivoted by said triggering means upon tripping thereof to thereby pivot said first locking lever arm out of locking engagement with said actuator means.

16. An auxiliary switch actuator mechanism according to claim 15, wherein said actuator means further includes a slot disposed in said base plate for locking engagement with a distal end of said first locking lever arm.

17. An auxiliary switch actuator mechanism according to claim 16, wherein the distal end of said first locking lever arm is formed to comprise a narrow finger portion for fitting within said slot in said actuator means and a shoulder for abutting engagement with the top surface of the base plate portion of said actuator means when said actuator means is in said normally-closed position.

18. An auxiliary switch actuator mechanism according to claim 17, wherien the second locking lever arm is generally J-shaped.

19. An auxiliary switch actuator mechanism according to claim 15, further comprising means for biasing the first locking lever arm towards said position of locking engagement with said actuator means.

20. An auxiliary switch actuator mechanism according to claim 19 further comprising means for normally biasing said actuator means toward said first locking lever arm.

21. An auxiliary switch actuator mechanism according to claim 20, further comprising means for pivotally mounting said base plate to said auxiliary switch in overlying engagement with said auxiliary switch movable contact means, and means for limiting the extent of pivotal movement of said base plate toward said first locking lever arm.

22. The actuator mechanism according to claim 16, wherein said slot is an open-ended channel.

23. The actuator mechanism according to claim 15, wherein said actuator arm portion is in abutting engagement with a planar surface of said movable breaker contact means.

24. The actuator mechanism according to claim 23, wherein said actuator arm portion is formed integrally with said base plate portion and extends at an angle to said base plate portion.

25. The actuator mechanism of claim 15, wherein said base portion of said actuator means comprises a recess for receiving a distal end of said locking lever means, said recess having a floor portion, a rear wall portion, and a step portion defining a raised edge portion disposed generally at the junction of said floor and rear wall portions.

26. The mechanism of claim 25 wherein said first locking lever arm is biased toward the rear wall of said recess.

27. The mechanism of claim 25 wherein said actuator means is biased generally toward the distal end of said locking lever means.

28. The mechanism of claim 25 wherein the second locking lever arm is generally J-shaped.

29. The mechanism of claim 25 wherein said actuator arm portion is adapted for abutting engagement with a generally planar surface of said movable breaker contact means.

30. A circuit breaker including an auxiliary switch actuator mechanism for a circuit breaker, comprising:

a frame;

a breaker mechanism mounted to said frame, said breaker mechanism comprising: a manually operable handle, breaker contact means pivotably mounted to said frame and movable between open and closed positions, collapsible linkage means coupling the handle and movable contact means;

sear pin means adapted to control the collapsible linkage, means for tripping said sear pin means to collapse said linkage responsive to an overcurrent through said breaker, and an auxiliary switch having a contact means movable between normally-open and normally-closed positions;

a movable contact arm mounting one of said breaker contacts;

an actuator arm biased for rotation about a first pivot axis and adapted to be moved between first, free, and second, locked, positions by said movable contact arm to control said contact means within said auxiliary switch, said actuator arm having a recess formed therein, said recess having a step formed in a wall thereof; and a locking lever pivotally mounted for rotation about a second pivot axis, said locking lever having a locking arm extending into said recess formed in said actuator arm and biased against the wall of said recess having said step formed therein, said step together with said locking defining stop means, whereby when said actuator arm is moved to a predetermined position, said stop means locks said actuator into its second locked position.

31. The circuit breaker according to claim 30, wherein:

said locking arm terminates in a squared end portion; and said squared end portion abuttingly engages said step within said recess in said actuator arm when said actuator arm is in said second locked position.

32. The circuit breaker according to claim 30 further comprising a breaker casing, and wherein said actuator arm is pivotally mounted to the breaker casing.

33. The circuit breaker according to claim 30, wherein said locking lever is mounted to said frame.

34. The circuit breaker according to claim 30, wherein said actuator arm is in abutting engagement with a planar surface of said breaker contact means.

35. The circuit breaker according to claim 30, wherein said actuator arm is biased upwardly such that the upward motion of the actuator arm is limited and controlled by the interaction between the end of said locking arm and the bottom of said recess.

* * * * *